United States Patent [19]

Warning

[11] Patent Number: 4,903,177

[45] Date of Patent: Feb. 20, 1990

[54] ORNAMENTAL LIGHT BULB MOUNTING

[76] Inventor: Donald Warning, 53 Irving Pl., New York, N.Y. 10010

[21] Appl. No.: 343,890

[22] Filed: Apr. 25, 1989

[51] Int. Cl.[4] ..... F21P 1/02

[52] U.S. Cl. ..... 362/123; 362/806; 248/231.8; 248/316.7

[58] Field of Search ..... 362/121, 122, 123, 806, 362/250; 248/231.8, 316.7, 300

[56] References Cited

U.S. PATENT DOCUMENTS

| | | | |
|---|---|---|---|
| 1,105,083 | 7/1914 | Lamb | 248/231.8 |
| 1,895,656 | 1/1933 | Gadka | 248/231.8 |
| 2,092,520 | 9/1937 | Nielsen | 40/455 |
| 2,232,505 | 2/1941 | Abbott | 248/231.8 |
| 2,299,733 | 10/1942 | Benander | 362/123 |
| 2,894,119 | 7/1959 | Stenger | 248/300 |
| 3,120,351 | 2/1964 | Kirsten | 362/123 |
| 3,123,514 | 3/1964 | Molinaro | 362/123 |
| 3,158,328 | 11/1964 | Kubak | 362/393 |
| 3,223,373 | 12/1965 | Molinaro | 248/339 |

*Primary Examiner*—James C. Yeung
*Attorney, Agent, or Firm*—Adrian T. Calderone

[57] ABSTRACT

A means for mounting ornamental light bulbs comprising a light bulb holder, and resilient arms at the bottom of the light bulb holder extending in opposite directions from each other. Each arm member has at its outward end an aperture for inserting a tree branch. The arms are bent to align the apertures and the holder is then mounted on a branch. The resiliency of the arms urges the arms back into the original position, thereby gripping the branch and frictionally holding the light bulb holder to the tree branch.

6 Claims, 2 Drawing Sheets

ORNAMENTAL LIGHT BULB MOUNTING

BACKGROUND OF THE INVENTION

1. Field of the Invention

This invention relates to light bulb mountings. More specifically it relates to mountings for ornamental lights such as those which are wrapped around Christmas trees, garden foliage, and the like.

2. General Background of the Prior Art

Proper placement of ornamental lights is important both to advertisers and consumers for holiday decorations. Commercial displays in retail stores, showrooms, studios, etc. especially require careful arrangement of the wired string of lights for a balanced appearance.

Up to now, in order to keep the lights in place, it has been customary to wrap the wires around the branches of the tree. However, this wastes a considerable amount of wire length. To ornament the tip of a tree branch, the decorator must wrap the wire by spiraling it around the branch until the lights reach the desired extent. Before he mounts the lights on another branch he must backtrack in another spiral to the center of the tree so as not to have wires drooping from the tip of one branch to the tip of another. It would save a great deal of wire, as well as time, if the decorator could simply extend the wire and backtrack linearly, without spiraling the wire around the branch.

A solution, of course, is to have a light bulb holder which is temporarily attachable by some means to a tree branch. The problem is to find a means for mounting the light bulb holders which is economical and easy to operate. Today's ornamental lights are small and numerous. Typical strings of Christmas lights come in lengths of 50 and 100 lights. Even a modestly sized tree can require more than one length of lights. Consequently, any mounting means should add very little to the cost per light, otherwise it would be economically unfeasible.

There is a need for a new type of light bulb holder for today's miniature ornamental lights to facilitate mounting these lights on Christmas trees branches, garden foliage, etc.

SUMMARY OF THE INVENTION

Therefore, it is an object of the present invention to provide a simple means for mounting ornamental lights on Christmas tree branches, garden foliage, and other linear or rod-like supports.

It is a further object of the present invention to provide a mounting means which is inexpensive.

It is yet another object of the present invention to provide a mounting means which is easily used.

The foregoing as well as other objects are realized in a means for mounting an ornamental light bulb on a linear support, said means comprising:

a light bulb holder, the bottom of said holder having first and second resilient arms, each extending perpendicularly to the axis of said light bulb holder, and in opposite directions from each other, said first and second resilient arms each having a distan end and an annular portion defining an aperture at said distal end, and said arms being moveable, in response to downward pressure, from a first position wherein the respective axes of the apertures are noncollinear to a second position wherein the respective axes of said apertures are collinearly aligned for inserting a linear support through them, and said resilient arms frictionally holding said linear support by being resiliently urged to their non-collinear first position when the downward pressure is removed.

Further objects and advantages of the present invention may be found in the following description of a preferred embodiment and the accompanying drawings.

DETAILED DESCRIPTION OF THE PREFERRED EMBODIMENTS

Figure 1:
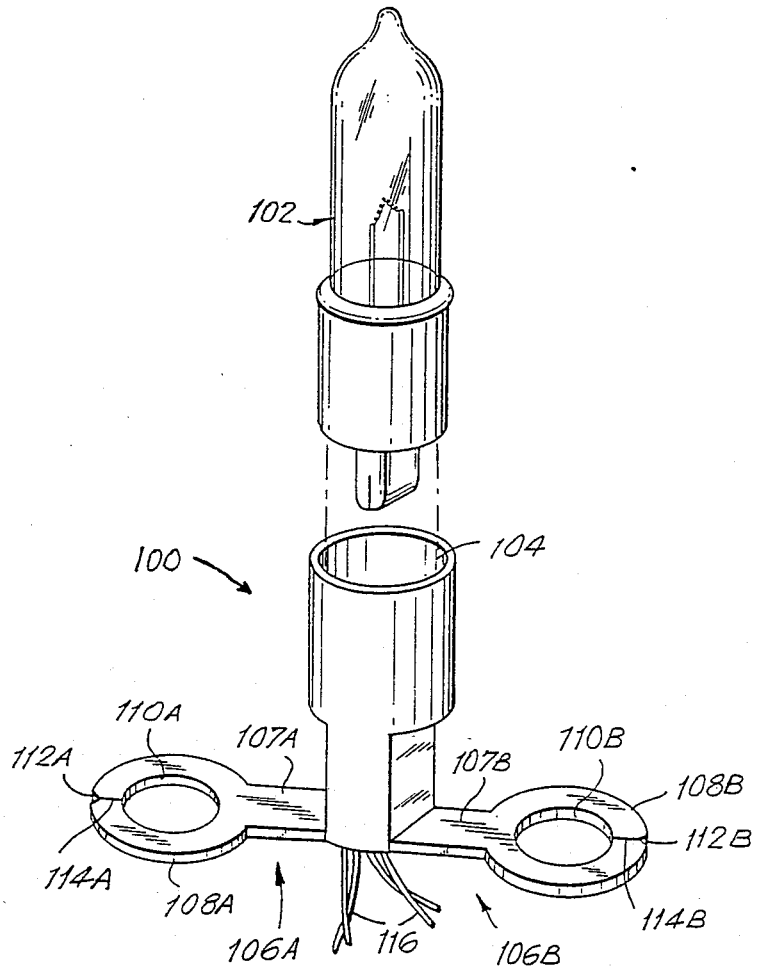
FIG.1 is an exploded view in perspective illustrating the light bulb holder.

FIG. 1 illustrates the present invention. Light bulb holder 100, which provides a base for a light bulb and the electrical contacts for illuminating the bulb, has an interior space 104 for inserting a light bulb 102. Electrical contacts are made inside the holder 100. Wires 116 carry the electrical current to the holder 100 and light bult 102. The bottom of light bulb holder 100 has two arm members, 106A and 106B, extending distally ( the term "distal" is used herein to mean a direction away from or farthermost from the holder 100) and perpendicularly from the axis of holder 100, and in opposite directions from each other. These arm members have relatively flat extensions 107A and 107B respectively, each of which terminates at their distal ends in an annular or ring-like portion 108A and 108B respectively. Annular portions 108A and 108B define apertures 110A and 110B respectively. To facilitate the mounting of the annular portions at a location on the tree branch spaced apart from the tip of the branch, each annular portion 108A and 108B is divided by a cut (114A and 114B respectively) at its distal end. Thus the annular portions may each be considered as being two finger members whose distal ends are in close adjacency to form a pincers-like structure. Notches 112A and 112B are located on the distal corners of the finger members. These notches 112A and 112B allow the annular portions 108A and 108B to open up for inserting the holder 100 onto a tree branch without having to insert the tree branch axially through the annular portions 108A and 108B.

The arm members 106A and 10B are made of a resilient material such as a polymer compound. In the preferred embodiment a composition comprising 75% by weight high density polyethylene and 25% by weight low density polyethylene is used. Other compositions are acceptable as long as they have sufficient resiliency. The entire holder is made as an integral piece from a single mold.

In an embodiment for miniature Christmas tree lights such as those commonly used at present, the arm members 106A and 106B may be 1 to 1½ millimeters thick and 2 millimeters wide. The end portions 108A and 108B may be 10 millimeters in diameter, and the apertures 110A and 110A may be 6 millimeters in diameter, or large enough to accommodate a tree branch.

As can be seen from the drawing in FIG.1 the arm members 106A and 106B extend in a direction distal to the axis of holder 100 and in opposite directions from each other. The axes of the apertures 110A and 110B are noncollinear, therefore in this position a straight tree branch cannot be inserted through both apertures.

Figure 2:
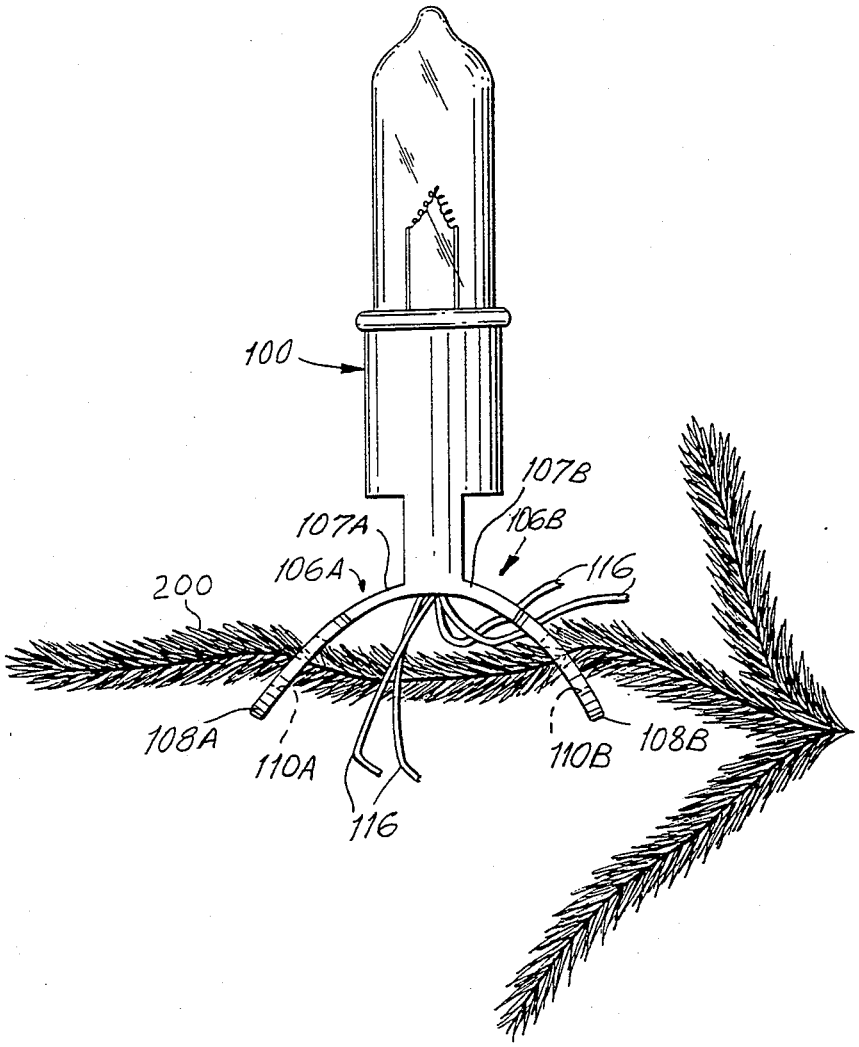
FIG. 2 is a side view showing how the light bulb holder is mounted on a tree branch.

FIG. 2 illustrates the operation of this invention. To mount the light bulb holder 100 on a tree branch 200 the user bends the arm members 106A and 106B by pressing down on them, thereby bringing the axes of apertures 110A and 110B into collinear alignment. This allows the insertion of a tree branch 200 through both apertures. The tree branch 200 may be inserted axially through the apertures 110A and 110B, or the user may mount the holder 100 perpendicularly by bending the arms so that the apertures 110A and 110B are substantially collinear, aligning notches 112A and 112B on the branch 200, and pressing down so as to open annular portions 108A and 108B at cuts 114A and 114B. The annular portions 108A and 108B will resiliently close when the holder 100 is fully mounted. When pressure is released, the resiliency of the arms 106A and 106B urges the end 108A and 108B upward into the first non-collinear position, thereby gripping the branch 202 by friction and securing the holder 100 to the tree. The electrical wires 116 do not have to be wound spirally around the branches to secure the light bulb holder.

While the above description contains many specifics, the reader should not construe these as limitations on the scope of the invention, but merely as exemplifications of preferred embodiments thereof. Those skilled in the art will envision many other possible variations that are within its scope. For example, skilled artisans will readily be able to change the dimensions and shapes of the various embodiments. They will also be able to make the invention of other materials. Accordingly the reader is requested to determine the scope of the invention by the appended claims and their legal equivalents, and not by the examples given above.

I claim:

1. A means for mounting an ornamental light bulb on a linear support, said means comprising:

a light bulb holder, the bottom of said holder having first and second resilient arms, each extending perpendicularly to the axis of said light bulb holder, and in opposite directions from each other, said first and second resilient arms each having a distal end and an annular portion defining an aperture at said distal end, said said arms being moveable, in response to downward pressure, from a first position wherein the respective axes of the apertures are non-collinear to a second position wherein the respective axes of said apertures are collinearly aligned for inserting a linear support through them, and said resilient arms frictionally holding said linear support by being resiliently urged to their non-collinear first position when the downward pressure is removed.

2. The ornamental light bulb mounting means of claim 1 wherein the annular portions of the first and second resilient arms each comprise two finger members, the distal ends of said finger members being in close adjacency with each other.

3. The ornamental light bulb mounting means of claim 2 wherein the annular portion is notched at the distal corners of the finger members.

4. The ornamental light bulb mounting means of claim 1 wherein the holder is made of resilient material.

5. The ornamental light bulb mounting means of claim 4 wherein the resilient material is a polymeric material.

6. The ornamental light bulb mounting means of claim 5 wherein the polymeric material is a composed of 75% high density polyethylene and 25% low density polyethylene.

* * * * *